US006695568B2

(12) United States Patent
Bares et al.

(10) Patent No.: US 6,695,568 B2
(45) Date of Patent: Feb. 24, 2004

(54) LOW PROFILE LIFT ARM FOR SMALL SKID STEER LOADER

(75) Inventors: Mark F. Bares, Oakes, ND (US); James H. Page, Bottineau, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/000,847

(22) Filed: Nov. 1, 2001

(65) Prior Publication Data

US 2003/0082040 A1 May 1, 2003

(51) Int. Cl.[7] ..... B66C 23/00

(52) U.S. Cl. ..... 414/722; 414/685

(58) Field of Search ..... 414/680, 685, 414/722; 180/9.1; 37/266, 264

(56) References Cited

U.S. PATENT DOCUMENTS

| | | | | |
|---|---|---|---|---|
| 1,371,344 | A | 3/1921 | Brackett | |
| D195,254 | S | 5/1963 | Keller et al. | D14/3 |
| D205,485 | S | 8/1966 | Juhl et al. | D14/3 |
| 3,411,647 | A | 11/1968 | Zimmerman | |
| 3,942,601 | A | 3/1976 | Smith | |
| 4,122,758 | A | 10/1978 | Bieringer et al. | 92/23 |
| 4,335,566 | A | 6/1982 | Hurd | 56/11.8 |
| 4,352,626 | A | 10/1982 | Frisbee et al. | 414/722 |
| 4,363,376 | A | 12/1982 | Sjoberg et al. | 180/275 |
| 4,558,558 | A | 12/1985 | Horner, Jr. et al. | 56/11.3 |
| D294,032 | S | 2/1988 | Whiffin | D15/25 |
| 4,904,151 | A | 2/1990 | Biemans et al. | 414/727 |
| 4,930,589 | A | 6/1990 | Henline | 180/19.1 |
| 4,947,705 | A | 8/1990 | Yates et al. | 74/529 |
| 4,991,681 | A | 2/1991 | Paulson | 180/275 |
| 5,009,566 | A | 4/1991 | Asche | 414/722 |
| D317,926 | S | 7/1991 | Lynnes et al. | D15/25 |
| 5,064,011 | A | 11/1991 | Ogano et al. | 180/9.22 |
| 5,212,896 | A | 5/1993 | Hillard et al. | 37/86 |
| 5,289,859 | A | 3/1994 | Minton, Jr. et al. | 144/2 N |
| 5,307,880 | A | 5/1994 | Woerner | 172/19 |
| 5,355,661 | A | 10/1994 | Tomiyama | 56/10.8 |
| D359,497 | S | 6/1995 | Rayner | D15/25 |
| 5,470,190 | A | 11/1995 | Bamford et al. | 414/686 |
| 5,479,728 | A | 1/1996 | Deken et al. | 37/142.5 |
| 5,494,125 | A * | 2/1996 | Gustin | 180/9.1 |
| 5,542,814 | A | 8/1996 | Ashcroft et al. | 414/786 |
| 5,575,513 | A | 11/1996 | Tuttle | 292/339 |
| 5,609,464 | A | 3/1997 | Moffitt et al. | 414/685 |
| 5,634,762 | A | 6/1997 | Kim | 414/685 |
| 5,647,721 | A | 7/1997 | Rohrbaugh | 414/686 |
| 6,021,373 | A | 2/2000 | Zuercher et al. | 701/300 |

(List continued on next page.)

OTHER PUBLICATIONS

Kanga brochure published prior to Nov. 1, 2000.
Website pages for Kanga loaders, Kanga kid PK 113, Kanga SuperKid, and KangaSuper Digger published date unknown admitted prior art.

(List continued on next page.)

*Primary Examiner*—Donald W. Underwood
(74) *Attorney, Agent, or Firm*—Westman, Champlin & Kelly, P.A.

(57) ABSTRACT

A small loader has a frame, and drive tracks on opposite sides of the frame. The, drive tracks are mounted over drive sprockets and idler wheels to establish lengths of track at upper sides. The frame includes upright members at a rear portion for mounting a lift arm assembly made of two lift arms joined together. Each lift arm has a rear portion pivotally mounted on the upright portion of the frame and extending downwardly and forwardly to join side portions of the lift arms that are substantially parallel to the upper lengths of the respective tracks in a lowered position of the lift arm assembly. Actuators for pivoting the lift arm assembly are mounted on the frame, below the side portions and above the tracks, and extend generally parallel to both the side portions and the upper length of the tracks when the lift arm assembly is in a lowered position.

10 Claims, 5 Drawing Sheets

U.S. PATENT DOCUMENTS

| | | | | |
|---|---|---|---|---|
| 6,098,385 | A | 8/2000 | Turk | 56/11.3 |
| 6,105,348 | A | 8/2000 | Turk et al. | 56/10.5 |
| D431,574 | S | 10/2000 | Porter | D15/25 |
| 6,151,811 | A | 11/2000 | Barreto | 37/352 |
| 6,171,050 | B1 | 1/2001 | Johnson | 414/685 |
| D438,218 | S | 2/2001 | McIlwraith | D15/25 |
| 6,397,967 | B1 | 6/2002 | McIlwraith | 180/308 |
| D463,454 | S | 9/2002 | Miller et al. | D15/22 |

OTHER PUBLICATIONS

U.S. patent application of James H. Page, Ser. No. 10/044,780 filed Jan. 10, 2002, based on U.S. provisional patent application Ser. No. 60/261,296 filed Jan. 12, 2001 (this shows the machine sold under the "Maximan" trademark).

Gravely Skid Steer Loader information, published at least as early as Nov. 1, 2000, 7 pages.

Dexhoff Equipment Brochure, "entitled the new TIPSKIP 650", (2 pages), Published before Nov. 1, 2000.

Mertz, Inc. Brochure, entitled "TrackMaster HP 800" (2 pages), Published before Nov. 1, 2000.

Thomas Equipment Ltd. Brochure, "25G" (Model 25G Specifications) (2 pages) Published before Nov. 1, 2000.

Mertz, Inc. Brochure, entitled "BOXER, America's first mini–skid steer with hydraulically adjustable track system." (2 pages), Published before Nov. 1, 2000.

Brochure on TORO DINGO "So What's on This Weekend's Agenda?", published prior to Nov. 1, 2000 (admitted prior art).

Maximan Brochure (5 pages), Published before Nov. 1, 2000.

Maximan Web Pages (2 pages), Admitted prior art, published before Nov. 1, 2000.

Attachments for Loader (Bobcat), Published 1996.

Mertz, Inc. Boxer Advertisement, published at least as early as Nov. 1, 2000, 3 pages. (Admitted prior art).

Toro Dingo Tract Utility Loaders, TX400 Series Advertisment, published at least as early as Nov. 1, 2000, 3 pages. (Admitted prior art).

Finn Skid Steer 250, Finn Corporation, published at least as early as Nov. 1, 2000, 5 pages.

Publications by Ramrod Equipment, Taskmaster Loaders, showing models 550, 750, 900, 910 and 944 with attachment pages, a total of 11 pages. Published at least as early as Nov. 1, 2000.

* cited by examiner

LOW PROFILE LIFT ARM FOR SMALL SKID STEER LOADER

BACKGROUND OF THE INVENTION

The present invention relates to a small loader that is manually operated by a standing operator at the rear of the loader. The loader has a low lift arm profile, so that an operator standing at the rear of the loader can see the work area. The low profile lift arms aid side-to-side visibility.

Various small self-propelled loaders have been advanced, where an operator will either stand or walk on the ground behind the loader or stand on a platform on the loader frame to manipulate the work element that is attached to the forward ends of pivoting lift arms.

These loaders find utility in small load applications, where loads that are too heavy for a person to lift can be hoisted. The ability of the loaders to be operated in small areas is important. Ease of manipulation of the bucket or work tool, as well as the ability to see the work that is being carried out is also important.

While it is desirable to have the pivot points for the boom near the rear of the small loader, and relatively high so that the reach is adequate for operation, conventional, straight lift arms tend to block vision to the side, as they are raised. Additionally, they will be in the way for access from the side of the loader to components such as the engine or drive components that are nested between the lift arms.

SUMMARY OF THE INVENTION

The present invention relates to a small self-propelled loader that is designed for operation by an operator standing at the rear of the loader, and which has forwardly extending lift arms that have center portions that are formed downwardly to have side portions at a low level, closely adjacent to the top of the components that are used for driving. The dropped or lowered side portions permit easy access to the center of the machine frame when the arms are lowered, and also keeps a low profile of the side portions of the arms they raise to insure good side-to-side visibility for the operator.

The lift arms are pivoted at the uppermost, rear portion of the frame, and extend forwardly to support a bucket, or other work implement at the forward ends of the arms. Hydraulic actuators are utilized for raising and lowering the lift arms, in a normal manner.

The far rear pivot of the lift arms permits using a longer arm on the same length machine. This increases the lift capacity for the same size actuator and there is a longer arc of movement. This means that the bucket or tool moves more vertically as it initially raises, rather that having a pronounced arcuate path that causes the bucket to move forward a significant amount as it starts to lift.

The lift arms taper downwardly from the pivot points to a position along the sides of the machine, and in the form shown extend forwardly substantially parallel to the top lengths of the tracks used for driving the machine. The forward ends of the lift arms then are recessed on the lower side so that they curve downwardly around the rounded forward ends of the tracks, where the tracks go over a front sprocket or guide wheel. When in a lowered position, the forward ends of the lift arms will support a bucket on the ground or support surface over which the tracks are moving.

Controls for the lift arms are all at the rear of the machine, and accessible by an operator standing on the ground or standing on a support platform at the rear of the machine.

The lift arm pivots are generally a little higher than waist high on an operator, so that the operator can see over the highest portions of the machine, for visibility. The operating control levers are just to the rear of the pivots for accessibility of the operator.

The lift arms are made into a rigid lift arm assembly with a cross member at the front end of the lift arms that also supports an upright strut for mounting a cylinder or actuator that is used for tilting the bucket or work implement.

The low profile lift arms thus provide an adequate lift reach or height, and are dropped in the center portions for accessibility to components and also for side to side visibility.

DETAILED DESCRIPTION OF THE ILLUSTRATIVE EMBODIMENTS

Figure 1:
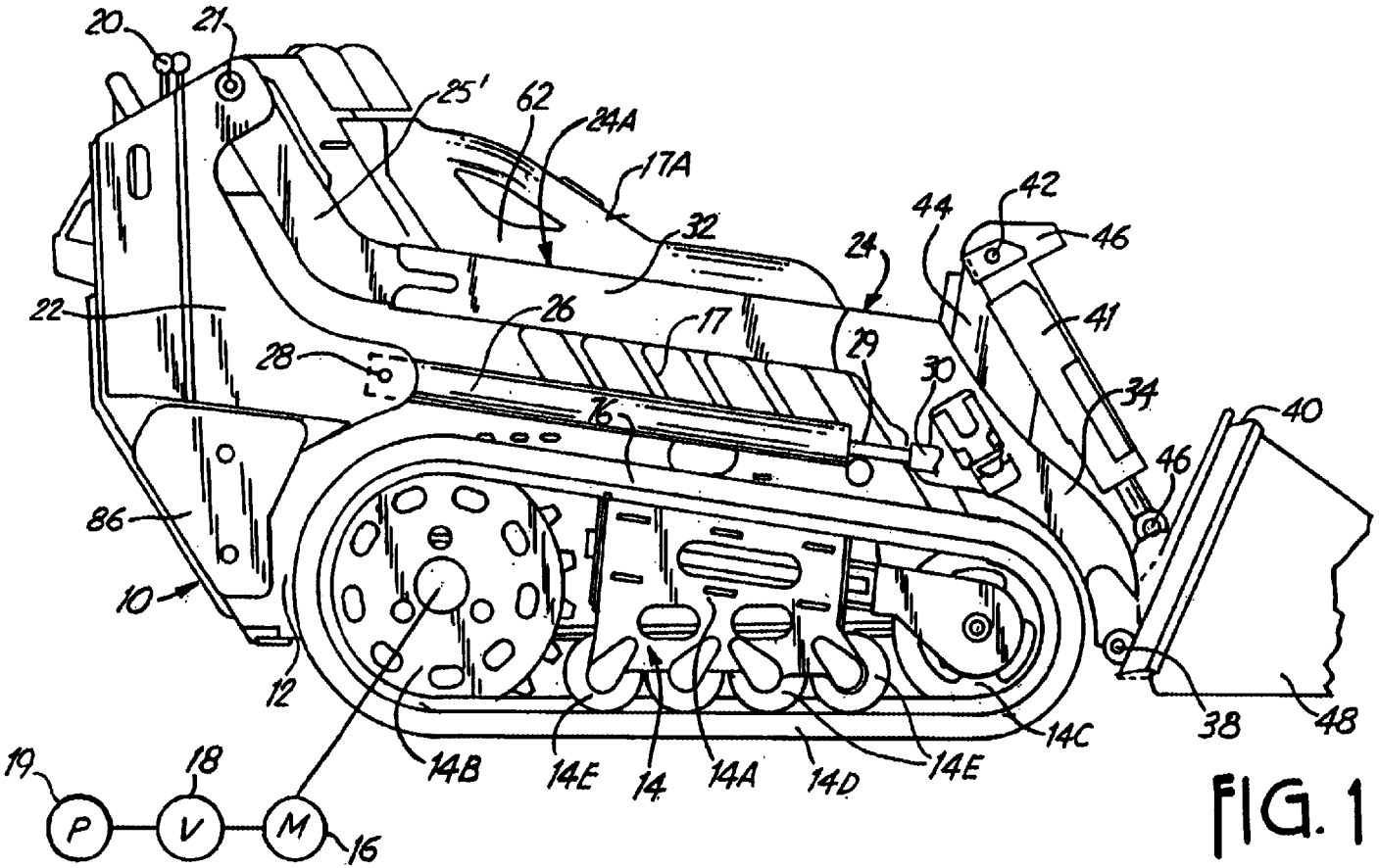
FIG. 1 is a side elevational view of a loader having lift arms made according to the present invention.

Referring to FIG. 1, a small loader indicated generally at 10 is a walk behind powered loader that has a body or frame 12. The frame 12 supports a track assembly 14 on each side of the loader, for propelling the loader in a forward or reverse direction through the use of drive hydraulic motors indicated generally at 16. Each track assembly includes a track frame 14A, a drive sprocket 14B and a front idler wheel 14C over which a track 14D is mounted. Bogie wheels 14E are also provided on the track frame for support. The drive motors 16 are operated through a pump 19 and individual valve arrangement 18 shown schematically for one motor. The valves for the motor and for the other hydraulic components are controlled by valve controls 20 at the upper end of a control panel for the loader. The pump 19 is driven by an internal combustion engine 45 mounted on the frame 12 in a housing 17 that has a cover 17A. The engine 45 is in the center portions of the loader, as shown.

The frame 12 has integral upright supports 22 at the rear of the frame, and the supports 22 extend upwardly a little higher than waist level of an operator standing on the ground. The upright supports 22 in turn pivotally mount rear ends of a lift arm assembly 24 on pivots 21 at the upper ends of the supports 22. As shown, the pivots 21 are at or near the uppermost part of the loader.

The lift arm assembly 24 includes individual lift arms 24A and 24B, on opposite sides of the frame, and each lift arm has a base end or rear plate portion 25 that inclines downwardly from the pivot 21 at an angle essentially parallel to the rear portions of the frame and engine cover. The base end portion 25 of each arm 24A and 24B has a bend 60 forming a forward end that is joined to a side lift arm portion 32, the side lift arm portions extend parallel to the upper lengths of the respective track of the track assembly on the respective sides of the loader. The side arm portions 32 join forward lift arm plate portions 34 that fit around the front of the tracks, respectively.

The lift arm assembly 24 is raised and lowered with extendible and retractable double acting hydraulic cylinders or actuators 26 operating under hydraulic pressure from the pump 19 and controlled by valves forming part of the controls 20.

The cylinders 26 (there is one on each side, and only one is shown) have base ends pivotally mounted as at 28 to portions of the frame 12, and the cylinders have extendible and retractable rods 29 that have rod ends that are pivotally mounted with pins 30 to each of the lift arms 24A and 24B of the lift arm assembly 24. The lift arms include the side arms 32, and forwardly extending lift arm plate portions 34 that curve forwardly over the forward ends 36 of the drive track 14D. There are side flanges 35 spaced from the plate portions 34 to provide support for the outer end pivot pins. The forward ends of the lift arms curve down and pivot pins 38 are used for mounting a quick attachment plate 40 to the lower ends of the forward plates of conventional design. The quick attachment plate 40 is the type normally used with the BOBCAT® skid steer loaders made by Bobcat Company Business Unit of Ingersoll-Rand Company.

The pins 38 permit the attachment plate 40 to be pivoted about a horizontal axis by a bucket control cylinder 41 that has its base end connected as at 42 to an upright strut 44 mounted on a cross member 70 that holds the lift arms 24A and 24B together to form the lift arm assembly 24. The rod end of the actuator or cylinder 41 is connected as at 46 to a bracket on the attachment plate 40. A bucket 48 is shown in position on the attachment plate 40, and this, too, is supported on the attachment plate 40 in a known manner.

Figure 3:
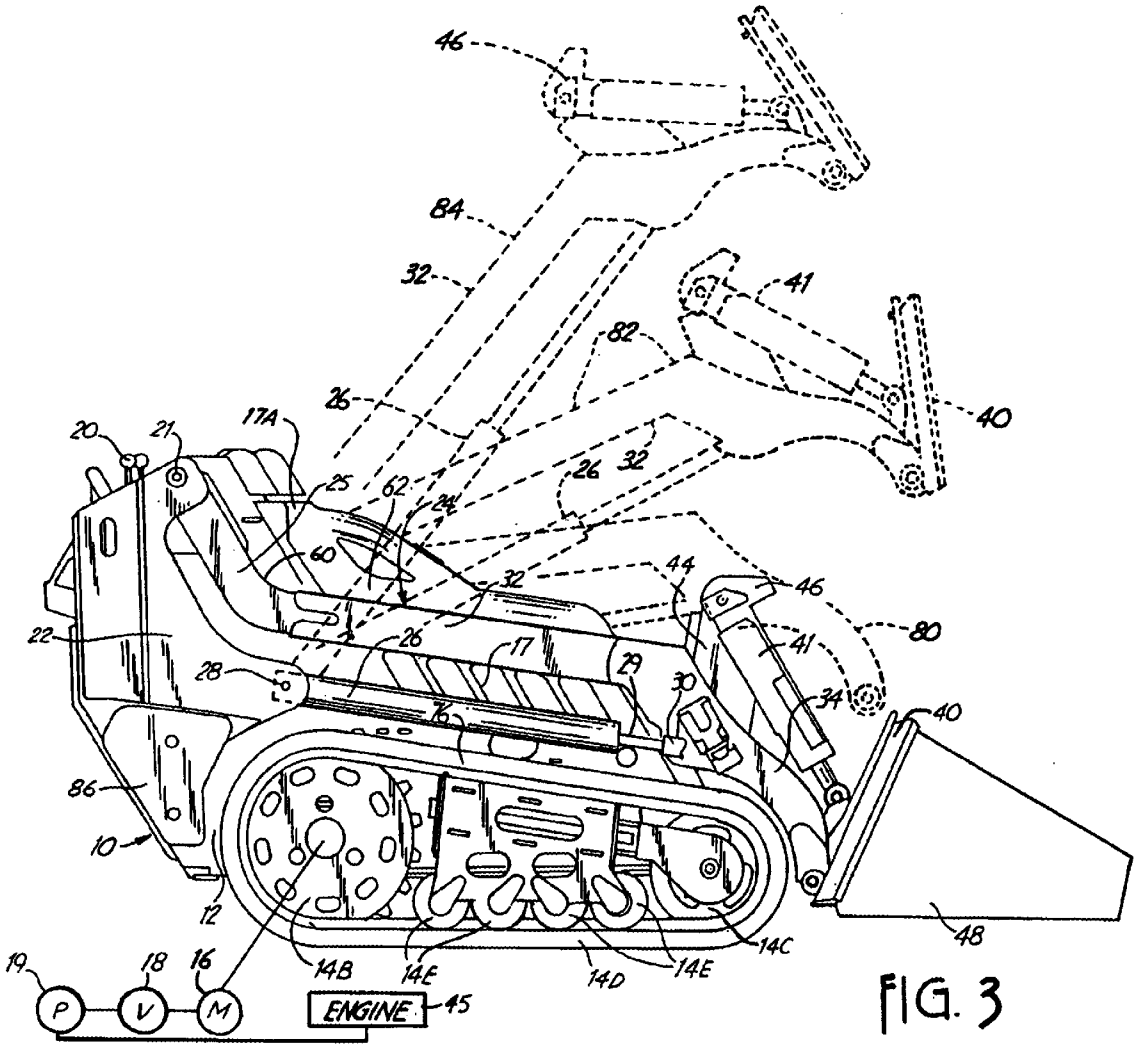
FIG. 3 is a view similar to FIG. 1 with a series of positions of the lift arm assembly shown in dotted lines.

When the lift arm actuators or cylinders 26 are fully extended, as shown fragmentarily in dotted lines in FIG. 3, the lift arms 24A and 24B are at a substantial upward angle. The upright 44 that is used for the bucket cylinder 41, is provided with an upwardly projecting backstop wall 46. If the bucket 48 is heaped with objects 52, and anything tends to roll out, the upright 46 will stop the material from rolling back along the lift arm assembly 24 toward the operator.

Figure 4:
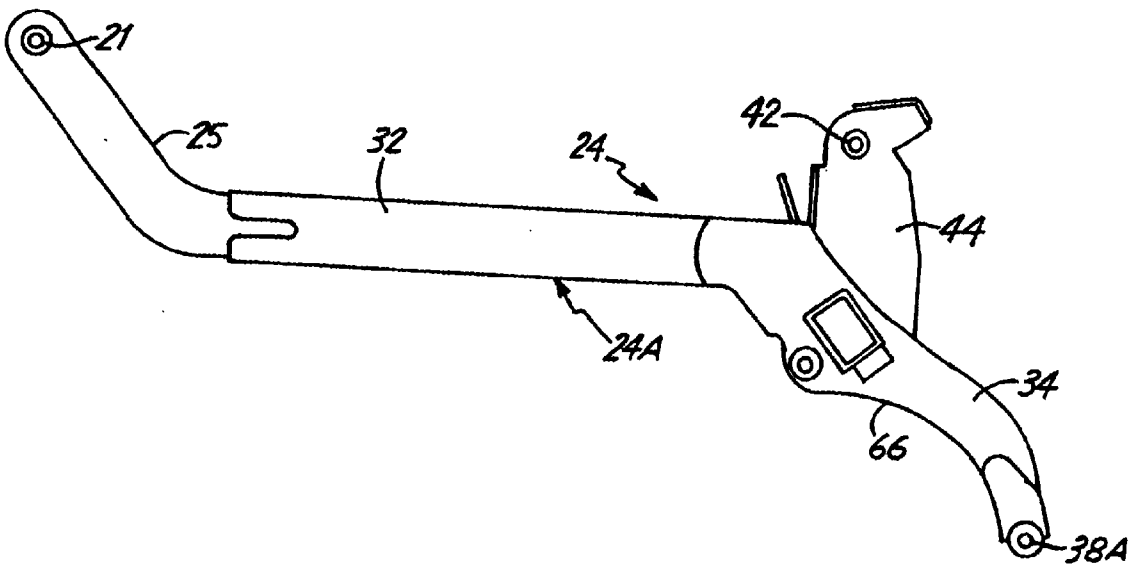
FIG. 4 is a side elevational view of the lift arm assembly removed from the loader.
Figure 6:
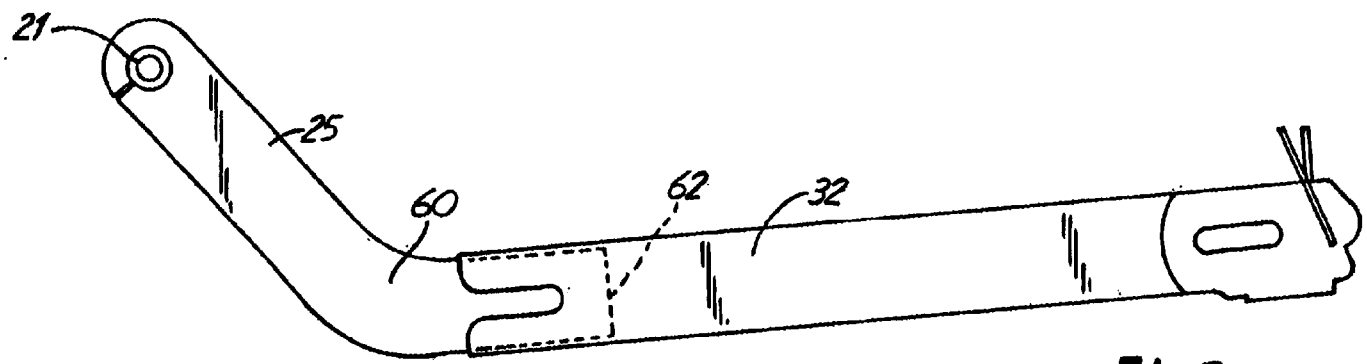
FIG. 6 is an enlarged side view of the assembly of the rear and side portions of a lift arm.
Figure 5:
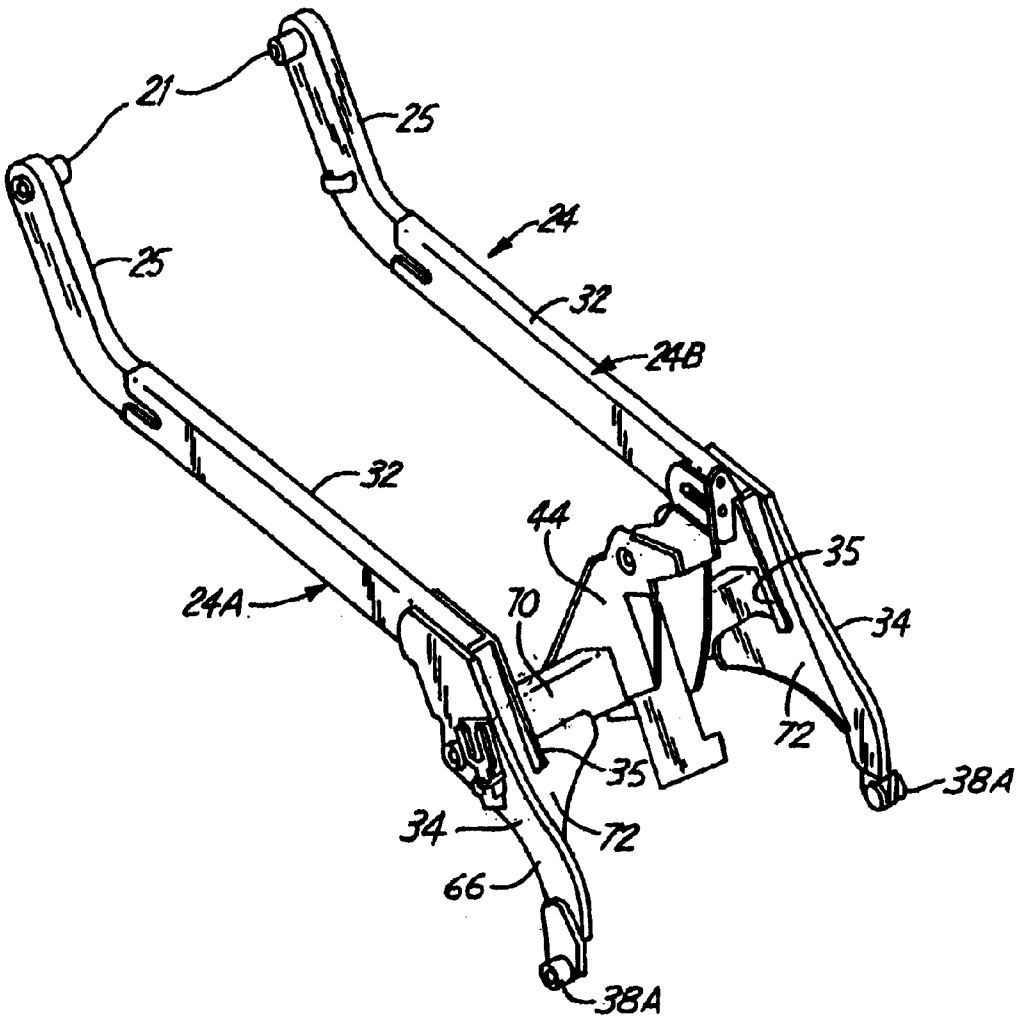
FIG. 5 is a front perspective view of the lift arm assembly removed from the loader.

As can be seen in FIGS. 4, 5 and 6, perhaps best, the base portion 25 of each of the lift arms 24A and 24B is made as a separate member that has a radius portion 60 at a lower end thereof, with a forwardly extending portion indicated generally in dotted lines at 62 that extends into a tubular interior of the tubular side arms portions 32. The rear portions can be plates of steel, or can be tubes, if desired. The forward lift arm portions 34 are plates, as can be seen perhaps best in FIG. 5. There are contoured recesses formed with a radiused surface 66 that is spaced from the forward ends of the tracks.

The lift arms 24A and 24B are joined together with a cross member 70 which is welded to the plates 34, and which is braced with gusset plates 72. The gusset plates 72 reinforce the forward lift arm plates 34, which hold pivot sleeves 38A for the pins 38. The upright 44 is suitable reinforced and gusseted back to the cross member 70 for additional strength. The plates 72 close the ends of the side arm tubes 32 of the lift arm assembly.

Figure 2:
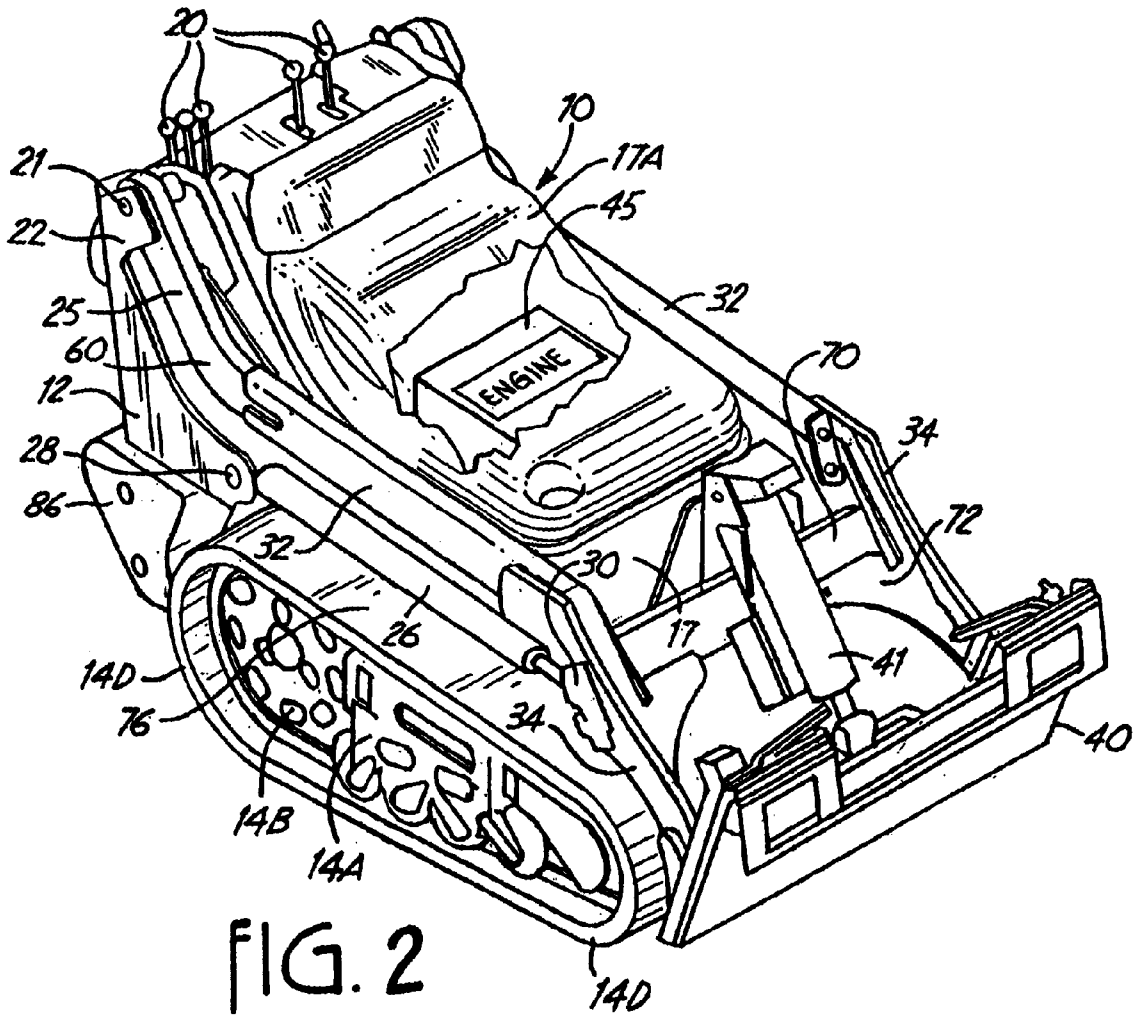
FIG. 2 is a perspective view of the loader of FIG. 1.

As can be seen in FIGS. 1 and 2, the side arm portions 32 are substantially parallel to and spaced upwardly from an upper length or reach 76 of the track 140 that forms part of the track assembly 14. The base portions 25 of the lift arms extend so that the side arm portions 32 are parallel to the longitudinal axis of the hydraulic actuators or cylinders 26. This geometry forms a compact assembly. The cylinder rod is attached to the plates 34, forming part of the forward lift arm portions so when the lift arms are lowered the cylinders 26 are in the position shown in FIG. 1. There is a substantial mechanical advantage even in this lowered position between the pivot point 21 and the base of the cylinders 26, where they join the frame shown at 28.

As the lift arms are raised, as shown in the various dotted line positions in FIG. 3, the cylinders 26 and the side arm portions remain fairly close to parallel, so that the lifting mechanical advantage remains substantially uniform relative to the pivots 21. Dotted line lift arm positions are shown at 80, 82 and 84. Position 84 is a fully raised position of the lift arms, and it can be seen that the cylinders 26 and the center portions 32 of the lift arms stay relatively close to parallel.

It should also be noted that the frame 12 can have counterweights 86 mounted thereon at the rear, the size and number are selected to be suitable for the type of operation that is being carried out with the loader.

In operation, the operator will stand or walk behind the loader, and operate the controls with the control handles 20 to move the loader through motors 16 and to raise and lower the lift arm assembly 24 as desired. The side-to-side visibility is greatly enhanced by having the offset section at the base end of the lift arm to drop the side portions 32 down along the sides of the housing for the engine and substantially parallel to the top reach or lengths of the tracks. Additionally, the moving of the side portions of the lift arm aids in lowering the center of gravity of the machine, particularly in the lower portions of the lift path. The lower center of gravity aids stability. The small loader that is disclosed has no operator's platform.

The propulsion system for moving the loader is disclosed specifically as a track unit. However, skid steer loaders are commonly mounted on wheels on the sides that are driven simultaneously on each side, from a separate motor on each side. The present loader can be wheel mounted, with the tops of the wheels on a plane parallel to the center portion of the lift arm and close to the top plane just like the top length of the track is positioned. Thus the propulsion system that supports the loader for movement can be sets of wheels mounted in place of the tracks shown.

Although the present invention has been described with reference to preferred embodiments, workers skilled in the art will recognize that changes may be made in form and detail without departing from the spirit and scope of the invention.

What is claimed is:

1. A loader having a frame, operator controls at the rear of the frame, accessible to an operator standing or walking at the rear of the frame, a propulsion system for moving the frame along a surface, including drive members on opposite sides of the frame, an engine on the frame mounted between the drive members, the frame having upright members at the rear portions thereof adjacent the controls and positioned at an upper most level of the loader, a lift arm for lifting loads including a base portion pivotally mounted to the upright member of the frame at a pivot above the controls, a center side portion, and a forwardly extending portion extending forwardly of the frame and adapted for supporting a work tool, an actuator for pivoting the lift arm about the pivot, the lift arm base portion inclining downwardly and forwardly from the pivot and joining the center side portion of the lift arm, the center side portion being above and adjacent the drive members in a lowered position of the lift arm and positioned alongside the engine compartment, and the lift arm center side portion joining the forwardly extending portion, the forwardly extending portion inclining downwardly from the center side portion for attachment to a work tool.

2. The loader of claim 1, wherein said lift cylinder is connected to the frame and extends forwardly to a forward end of the lift arm, said lift cylinder and the center side portion of the lift arm being substantially parallel when the lift arm is in a lowered position.

3. The loader of claim 2, wherein the actuator has an extendible and retractable rod connected to the lift arm at a forwardly extending portion of the lift arm about a pivot portioned relative to the pivot of the lift arm to the frame, and relative to the pivot of the base of the actuator to the frame, such that the spacing between the center side portion of the lift arm and the actuator remains substantially the same throughout the travel of the lift arm from a lowered to a raised position.

4. The loader of claim 1, wherein said lift arm comprises one lift arm of a lift arm assembly having two lift arms, one lift arm on each of opposite sides of the engine compartment, a cross member at a forward end of the lift arms for rigidly joining the lift arms in spaced apart relationship.

5. The loader of claim 4, wherein said forward portions of said lift arms comprise plate members joined to the center side portions, and extending downwardly and forwardly from the center side portions.

6. The loader of claim 1, wherein said drive members comprise endless tracks that have front and rear mounting members for the tracks to provide an upper lengths of track, on the opposite sides of the frame, the lift arm comprising a lift arm assembly having lift arms on the opposite sides of the frame above the respective upper lengths of track, and an actuator for each lift arm, the upper length of track, the actuator, and the center side portion of the lift arm on the opposite sides of the frame being substantially parallel with the upper length of track on the respective side of the frame in a lowered position of the lift arm assembly.

7. The loader of claim 6, wherein the rear mounting member of each track comprises a drive sprocket and the front member comprises an idler wheel, said drive sprocket being larger than the idler wheel.

8. The loader of claim 7, wherein said forwardly extending portions of the lift arms are formed concave on the bottom sides thereof to generally follow the contour of the track that is supported around the idler wheel.

9. The loader of claim 4, and gusset members holding the plates for forming the forwardly extending portions of the lift arms relative to the cross member.

10. The loader of claim 1, wherein said base portion of said lift arm comprises a plate having a bend therein, and said center side portion of said lift arm is a tube of larger size than the plate having an interior opening, an end of the base portion slipping into the interior opening of the side portion, said plate having a bend therein to permit the base portion to extend downwardly and forwardly from its pivot to the center side portion.

* * * * *